US005749018A

United States Patent [19]

Wess et al.

[11] Patent Number: 5,749,018

[45] Date of Patent: May 5, 1998

[54] PHOTOGRAPHIC PROCESS WITH IMPROVED REPLENISHMENT MONITORING SYSTEM

[75] Inventors: Raymond E. Wess, Holley; Ralph L. Piccinino, Jr., Rush; John H. Rosenburgh, Hilton, all of N.Y.

[73] Assignee: Eastman Kodak Company, Rochester, N.Y.

[21] Appl. No.: 785,116

[22] Filed: Jan. 21, 1997

Related U.S. Application Data

[63] Continuation-in-part of Ser. No. 655,106, May 29, 1996, Pat. No. 5,689,748.

[51] Int. Cl.[6] ..... G03D 3/02

[52] U.S. Cl. ..... 396/578; 396/626; 73/304 R

[58] Field of Search ..... 396/626, 630, 396/570, 578, 638; 73/290 R, 293, 302, 304 R, 308; 340/620, 624

[56] References Cited

U.S. PATENT DOCUMENTS

| | | | |
|---|---|---|---|
| 3,787,829 | 1/1974 | Schneier | 340/244 |
| 4,410,120 | 10/1983 | Lorenz | 73/293 |
| 4,451,433 | 5/1984 | Yamashita et al. | 73/308 |
| 5,011,571 | 4/1991 | Kobayashi et al. | 396/571 |
| 5,070,351 | 12/1991 | Vanover et al. | 396/626 |
| 5,313,243 | 5/1994 | Rosenburgh et al. | 396/571 |
| 5,541,698 | 7/1996 | Van Den Bergen | 396/568 |

FOREIGN PATENT DOCUMENTS

| | | | |
|---|---|---|---|
| 2300277 | 10/1996 | United Kingdom | 396/942 |

*Primary Examiner*—D. Rutledge
*Attorney, Agent, or Firm*—Frank Pincelli; David A. Novais

[57] ABSTRACT

A method and apparatus for processing a photosensitive material. The apparatus includes at least one processing section and a replenishment system for delivering replenishment solution contained within a container to the processing section. The replenishment system including a single device for withdrawing replenishment solution from the container and for monitoring the level of the replenishment solution contained in the container. The container is made of a material that is electrically non-conductive. A pair of spaced electrically conductive members are provided within the container. One of the members has a passageway for allowing flow processing solution therethrough and one has a terminal end which extends below the other member within the container. An AC current is applied to the pair of spaced members and the AC current is monitored with a level sensing circuit. When the replenishment solution falls below the end of the shorter member, a low level indicating signal is produced by the level sensing circuit.

18 Claims, 7 Drawing Sheets

PHOTOGRAPHIC PROCESS WITH IMPROVED REPLENISHMENT MONITORING SYSTEM

CROSS REFERENCE TO RELATED APPLICATIONS

This is a continuation-in-part of application Ser. No. 08/655,106, filed May 29, 1996, now U.S. Pat. No. 5,689,748, entitled "Photographic Process with Improved Replenishment Monitoring System", by Raymond E. Wess, Ralph L. Piccinino, Jr., and John H. Rosenburgh.

FIELD OF THE INVENTION

The present invention relates to a photographic processor, and more particularly, to a method and apparatus for monitoring the liquid level and dispensing of a photographic processing solution.

BACKGROUND OF THE INVENTION

In photographic processors it is important to monitor the supply of replenishment solution in the replenishment container from which the replenishment solution is drawn. If there is too small of an amount of replenishment solution remaining in the supply container, then there exist the danger of drawing air into the replenishment system. This is very undesirable for a number of reasons. If air is drawn into the replenisher pump this can result in damage to the pump, or an air lock to occur which will prevent replenishment solution from being supplied which will then affect the overall chemical balance of the processing solution. Additionally, the presence of air in certain processing solutions, such as developer, can result in undesirable oxidization which will break down the processing solution and significantly affect the effectiveness of the processing solutions. It is also important to maintain the level of the processing solution in the processing tank above a minimal level. If the level of the processing solution falls too low in the processing tank the effectiveness of the processing solution at that station can be seriously affected. When the level in the processing tank falls below a predetermined level additional processing solution is provided to the processing tank. From the foregoing, it can be seen that it is important to properly monitor the liquid level of the replenishment solution in the replenishment container and in the processing tank. It is known to monitor an AC current applied to probes placed in the container holding replenishment solution for mounting the level of the liquid.

It is also necessary to provide an appropriate system for withdrawing the replenishment solution from the replenishment container and supplying additional processing solution to the processing tank. The system must be resistant to the corrosive effects of the processing solution. It is also desirable to minimize the cost of the system without sacrificing the reliability of the system.

Applicants have invented an improved liquid level sensing and delivery system which can be used in corrosive environmental applications such as that found in photographic processors for providing accurate information upon which replenishment liquid level can be monitored and for the dispensing of the replenishment from the replenishment container or for supplying processing solution to the processing tank. The system is of simple design and construction, low cost to manufacture, and easy to assembly.

SUMMARY OF THE INVENTION

In one aspect of the present invention there is provided a processor for processing a photosensitive material. The processor having at least one container for holding a processing solution and a processing solution level monitoring and delivery system for monitoring the level of said processing solution within said processing container and for controlling the flow of processing solution to or from said container. The system includes a single assembly for controlling the flow of processing solution to or from the processing container and for monitoring the level of the solution in said processing container.

In another aspect of the invention there is provided an apparatus for processing a photosensitive material. The apparatus having at least one processing tank for holding a processing solution. A processing solution level monitoring and replenishment system is provided for monitoring the level of the processing solution within said processing tank and for delivering replenishment solution to said processing tank. The replenishment system including a single means for supplying replenishment solution to said processing tank and for monitoring the level of the replenishment in said processing tank.

In yet another aspect of the present invention there is provided a method for supplying or withdrawing a processing solution to or from container and for monitoring the level of said processing solution within said container in a photographic processor. The method comprising the steps of:

- providing a first electrically conductive member within said container and a spaced second electrically conductive tube within said container, said tube having a passageway for allowing processing solution to flow therethorugh;
- applying an AC current to said rod and said tube;
- monitoring said AC current with a level sensing circuit; and
- producing a low level indicating signal based on said monitoring of said AC current.

DETAILED DESCRIPTION OF THE DRAWINGS

In the detailed description of the preferred embodiment of the invention as presented below, reference is made to the accompanying drawings in which.

DETAILED DESCRIPTION OF THE INVENTION

Figure 1:
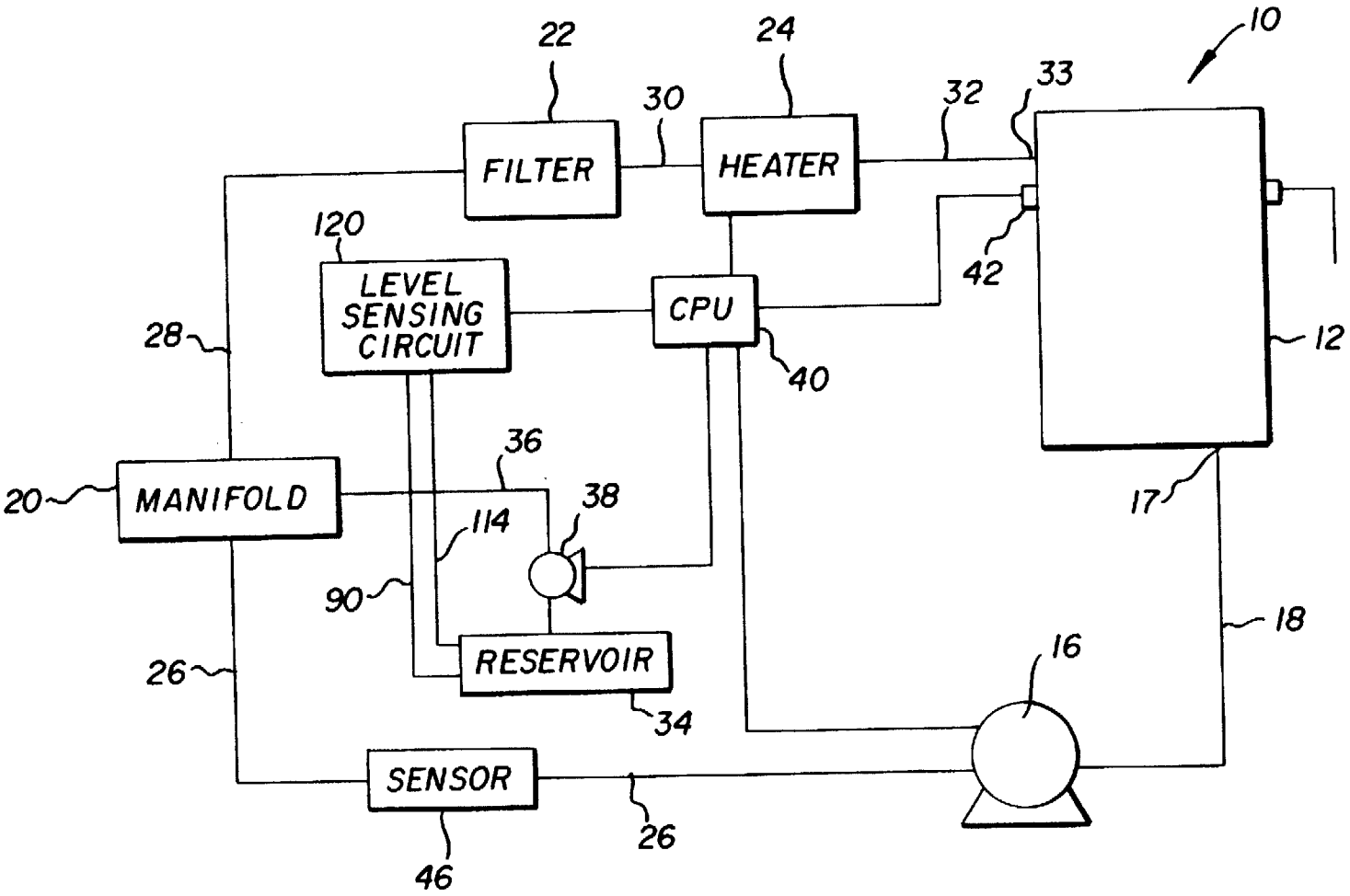
FIG. 1 is a schematic diagram of a processing apparatus made in accordance with the present invention.

Referring to FIG. 1, there is illustrated a processing apparatus 10 for processing photosensitive material made in accordance with the present invention. The processing apparatus 10 includes a processing tank 12 wherein photosensitive material is subjected to a photoprocessing solution and a recirculation system 14 (as best seen in FIG. 2) for recirculating processing solution through the processing tank 12.

In the particular embodiment illustrated in FIG. 1, the recirculation system 14 includes a pump 16 which is connected to the outlet 17 of processing tank 12 by first conduit 18. The recirculation system further includes a manifold 20, a filter unit 22, and a heater 24. The pump 16 is fluidly connected to manifold 20 by a second conduit 26 and the manifold 20 is fluidly connected to filter unit 22 by a third conduit 28. A fourth conduit 30 fluidly connects the output of the filter unit 22 to the input of heater unit 24 and the output of the heater 24 is fluidly connected to the processing tank 12 by a fifth conduit 32. Thus, processing solution can flow from the output 17 of the processing section through first, second, third, fourth and fifth conduits returning to the inlet 33 of the processing section.

The manifold 20 serves as a means for introducing replenishment solution from a reservoir 34 into the recirculation system 14. The reservoir 34 is fluidly connected to the manifold by appropriate sixth conduit 36 and is introduced from the reservoir 34 by pump 38. As is typical with photographic processors, a CPU 40 (central processing unit/computer) is provided for controlling the operation of the apparatus. As is illustrated, the central processing unit 40 is connected to pumps 16,38 and to sensor 42 provided in the processing tank 12. The sensor 42 is a liquid level sensor for sensing when additional processing solution is required. Recirculation system 14 includes a flow monitoring sensor 46 which is used to determine if processing solution is properly flowing through the processing recirculation system 14.

Figure 2:
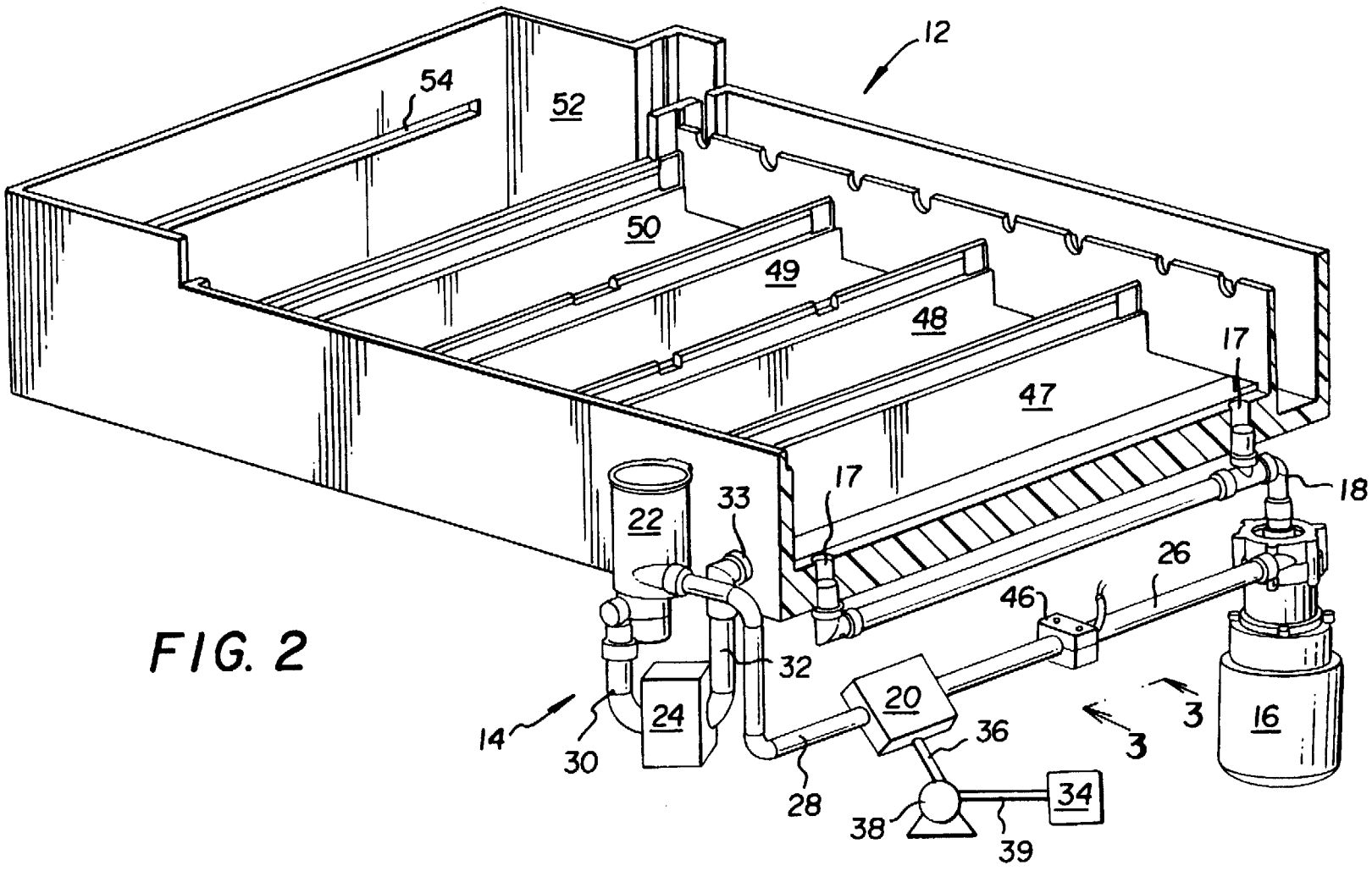
FIG. 2 is a perspective view partially broken away of a portion of an apparatus made in accordance with FIG. 1.

Referring to FIG. 2, there is shown a perspective view of a portion of the processing apparatus 10 illustrating the processing tank 12 and recirculation system 14. In the particular embodiment illustrated, the processing tank 12 includes four separate developing sections 47,48,49,50, each designed to contain a different processing solution. In particular, development section 47 is designed to hold a developer solution, developing section 48 is designed to hold a bleach fixed solution, and sections 49,50 are designed to hold rinse and wash solutions. Each of the processing sections include a recirculation system 14 as described and illustrated in FIG. 1, but for the sake of clarity, only a single recirculation system is illustrated in FIG. 2, it being understood that each of these processing sections have a recirculation system 14 as described and illustrated. A drying section 52 is provided after the processing section wherein the photosensitive material is dried prior to exiting slot 54. In the particular embodiment, a pair of outlets 17 are fluidly connected to conduit 18. Reservoir 34 is fluidly connected to replenishment pump 38 by conduit 39. Pump 38 draws replenishment solution from reservoir 34 and delivers it to manifold 20 through conduit 36.

Figure 3:
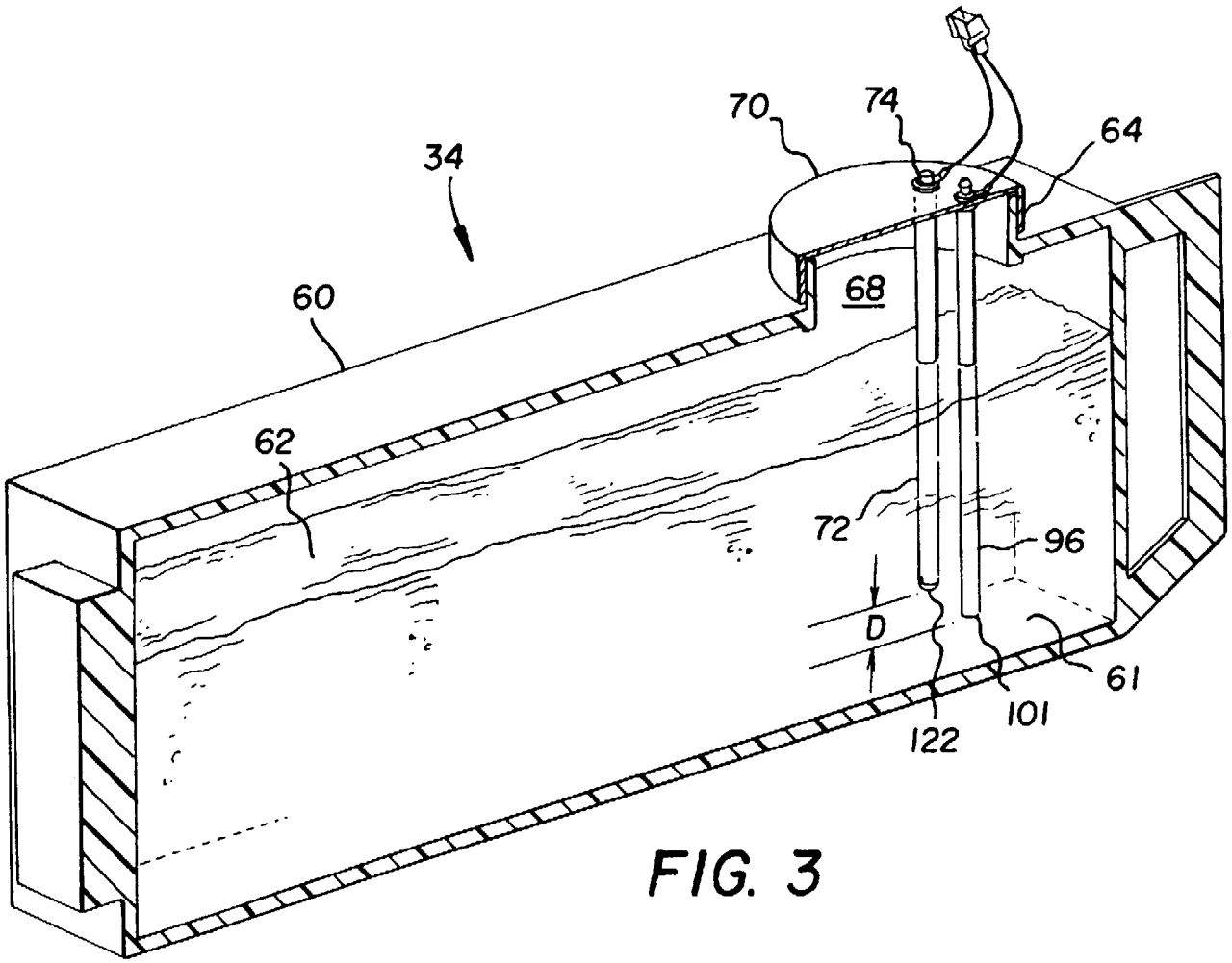
FIG. 3 is an enlarged cross-sectional view of a replenishment container made in accordance with the present invention for use in the apparatus of FIGS. 1 and 2.

Referring to FIG. 3, there is illustrated in greater detail the reservoir 34 made in accordance with the present invention. In particular, the reservoir 34 comprises a container 60 for holding a replenishment solution 62. As is typical, replenishment solution 62 is electrically conductive. The container is provided with a generally cylindrical neck portion 64 having an access opening 68 for dispensing and/or filling of replenishment solution 62 in container 60. A lid 70 is provided for engaging the neck portion 64 covering access opening 68. The use of lid 70 avoids spilling and minimizing oxidation of the replenishment solution 62. The container 60 and lid 70 are made of a non-conductive material, for example, plastic. In the embodiment illustrated, container 60 and lid 70 are made of polypropylene.

Figure 5:
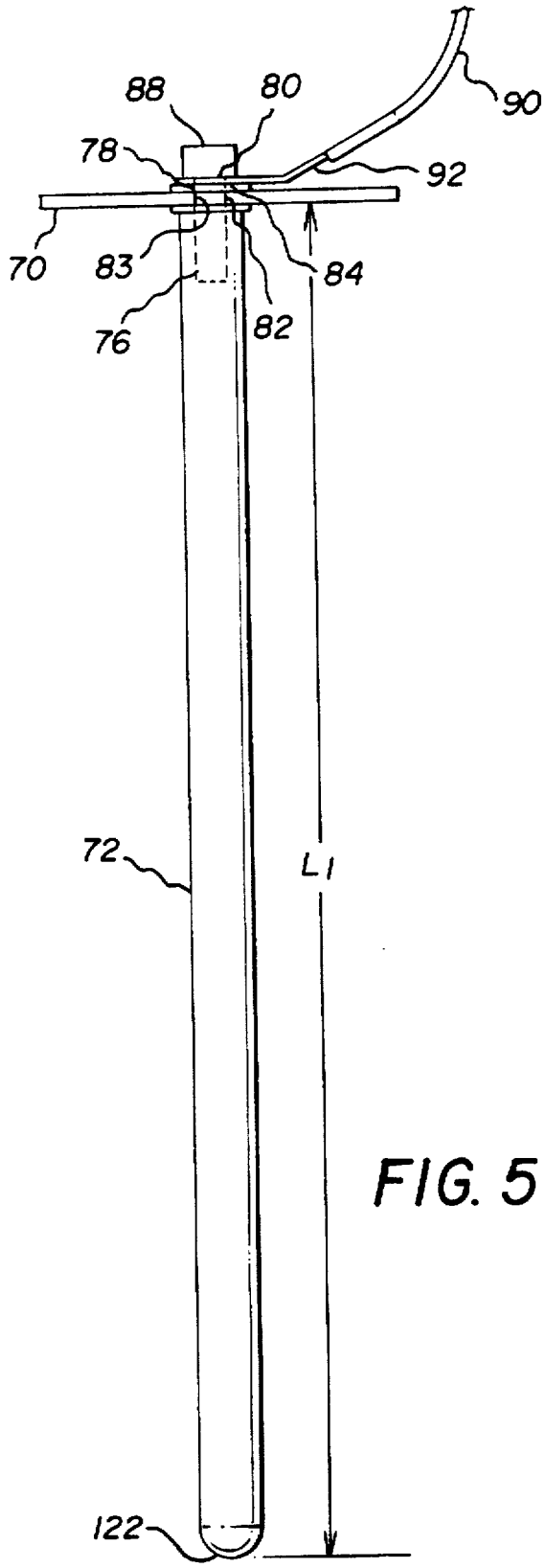
FIG. 5 is an enlarged side view of the rod used in the container of FIG. 3.

The apparatus 10 includes means for monitoring the level of the replenishment solution 62 within the container 60 and for withdrawing of the replenishment solution 62. In particular, a first level sensing rod 72, of a first predetermined length L1, is provided for placement in container 60 and has an upper end 74 which is secured to lid 70 by any conventional technique. Rod 72 is made of a conductive and corrosive resistant material. In the embodiment illustrated, rod 72 is made of an electrically conductive stainless steel. Referring to FIG. 5, there is illustrated in greater detail how rod 72 is secured to lid 70. Rod 72 is provided with internal threads 76 for engaging the external threads 78 of electrically conductive mounting screw 80. Mounting screw 80 passes through an opening 82 in lid 70. An electrical ring terminal 84 having an opening 83 is provided and positioned for placement between the head 88 of screw 80. An electrical wire 90 has end 92 connected to terminal 84. The other end of the wire 90 is connected to an electronic control board (not shown) through connector 93 (see FIG. 3) which is controlled by CPU 40. When screw 80 is threaded into rod 72 it will cause the rod 72 to be secured to the lid 70 while also clamping the terminal 84 to the lid 70 and providing electrical connection to rod 72.

Figure 6:
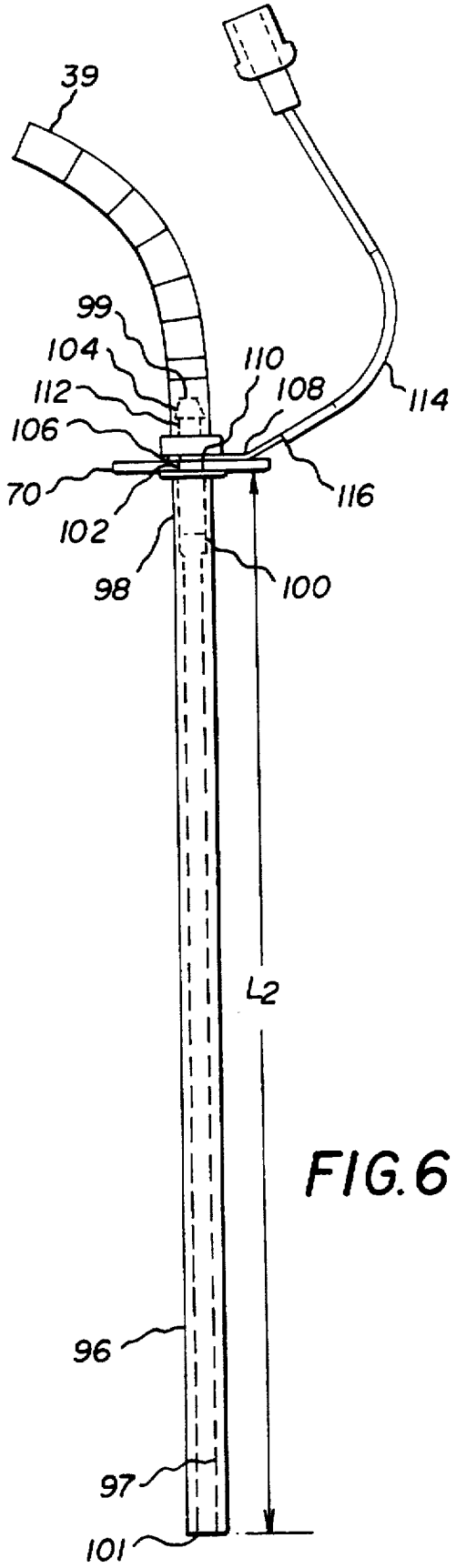
FIG. 6 is an enlarged side view of the tube used in the container of FIG. 3.

The means for monitoring the level of the processing solution within the container 60 and for withdrawing of the replenishment solution 62 further includes a second level sensing tube 96 (see FIG. 6) of a second predetermined length L2 and has an upper end 98 which is secured to lid 70 by any conventional technique. Tube 96 has an internal passage 97 which extends through the length L2 and terminates in an inlet opening 101 for drawing replenishment solution 62 therein. The tube 96 is made of a conductive and corrosive resistant material, and in the particular embodiment illustrated, is made of an electrically conductive stainless steel. Referring to FIG. 6, there is illustrated in greater detail how tube 96 is secured to lid 70. Tube 96 is provided with internal threads 100 for engaging the external threads 102 of electrically conductive mounting fitting 104. Mounting fitting 104 passes through an opening 106 in lid 70. An electrical ring terminal 108 having an opening 110 is provided and positioned for placement between the head 112 of fitting 104. An electrical wire 114 has end 116 connected to terminal 108. The other end of the wire 114 is connected to an electronic control board (not shown) also through connector 93, which is controlled by CPU 40. When fitting 104 is threaded into tube 96, it will cause the tube 96 to be secured to the lid 70 while also clamping the terminal 108 to the lid 70 and providing electrical connection to tube 96. The fitting has an internal passage 99 which is in fluid communication with the passage 97 of tube 96. Conduit 39 is fluidly connected to fitting 104.

A level sensing circuit 120 is connected to other ends of wires 90,114 and provides an AC current through tube 96 and rod 72. The level sensing circuit 120 sends a monitoring signal to CPU 40 which is representative of the presence of the replenishment solution 62 in container 60. AC current is used so as to prevent plating of the rod 72 and tube 96. Any appropriate amount of current may be applied to rod 72 and tube 96. In the particular embodiment illustrated, AC current in the range of about 200 to 300 microamps are applied.

In order to more clearly understand the present invention, a description of its operation will now be discussed. First a container 60 which is filled with a replenishment solution 62 is provided. The lid 70 with secured rod 72 and tube 96 is placed on neck 64. The length L2 of tube 96 is greater in length than the length L1 of rod 72. The length L2 is such that opening 101 is closely adjacent the bottom 61 of container 60. The level sensing circuit 120 (see FIG. 1) is activated so as to provide an AC current through rod 72, tube 96 and replenishment solution 62. Since replenishment solution 62 is electrically conductive, a signal will be detected by the level sensing circuit 120 as long as the replenishment solution completes the electrical connection between the rod 72 and tube 96. In the embodiment illustrated, the level sensing circuit 120 is an LM1830 integrated circuit which may be purchased from a typical electronic supplier, such as the National Semiconductor Corporation. When the level of the replenishment solution 62 falls below the bottom end 122 of rod 72, the AC current is interrupted causing the level sensing circuit 120 to detect a change in condition which is representative of the lack of presence of the replenishment solution, that is, the level of the replenishment solution 62 is below end 122. The level sensing circuit 120 then sends an appropriate signal to CPU 40 which in turn turns off pump 38. If desired, an alarm or signal may be provided for notifying an operator of the condition of the liquid level in the container 60. The length L1 and L2 are selected so that most of the replenishment solution will have been removed from container 60, yet having a difference in length D is such that the pump 38 will be turned off prior to taking air into tube 96. In the particular embodiment illustrated, the difference in length between L1 and L2 is approximately ¼ inches (0.632 cm). However, the difference may be any desired amount so long as it provides the appropriate signal in sufficient time prior to drawing air into the tube 96.

As can be seen, the rod 72 and tube 96 not only supply replenishment solution, they also provide means for sensing the presence of fluid. Additionally, the system is relatively simple in construction, low cost, and very reliable.

Figure 4:
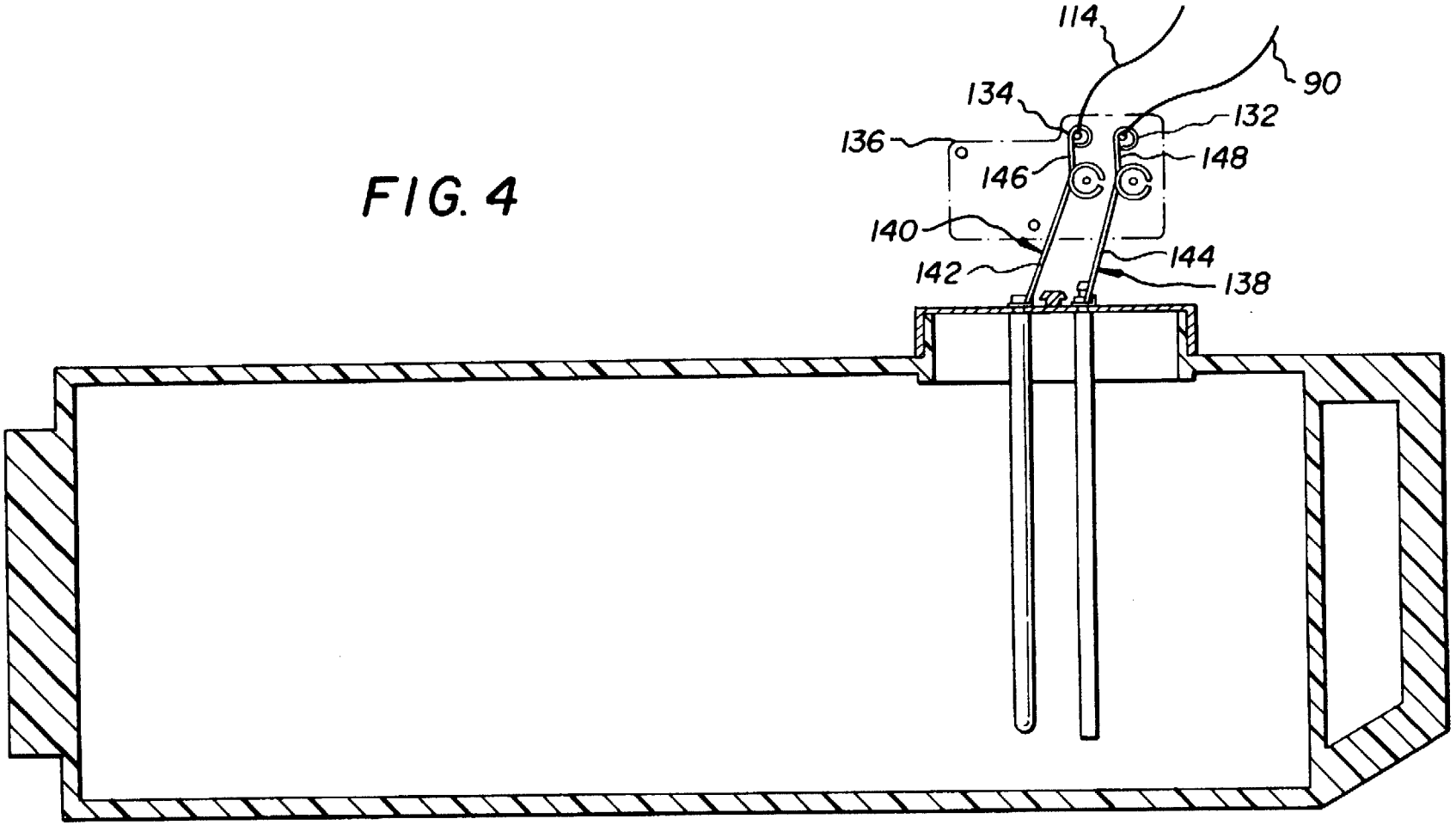
FIG. 4 is a cross-sectional view of a modified replenishment container made in accordance with the present invention.

Referring to FIG. 4, there is illustrated a modified form of the present invention. This system is similar to that of FIG. 2, like numerals indicating like parts and operation, previously described, and is incorporated herein. In this embodiment there is provided an automatic quick disconnect assembly 130 for allowing quick disconnect of the electrical wires 90,114. In this embodiment wires 90,114 are connected to electrical terminals 132,134, respectively, on an electrical mounting plate which is secured to apparatus 10. A pair of electrical conductive spring members 138,140 are secured to mounting plate 135. Each spring member 138,140 has a flexible lower spring end 142,144 which contact terminals 84,108, respectively, when the container is properly seated in apparatus 10. Members 138,140 each have an upper portion 146,148, respectively, which are designed to contact terminals 132,134 on plate 135. Thus, there is provided electrical connection between rod 72, tube 96, and wires 90,114, respectively. When the container 60 is removed from apparatus, the lower ends 142,144 deflect so as to allow removal of the container. Likewise, the members flex to allow insertion of a freshly filled container 60. In this manner no manual electrical disconnection of wires 90,114 is required. Electrical connection is automatically made simply by proper positioning of the container 60. Once conduit 39 is disconnected from fitting 104, the container is simply removed for refilling and/or replacement.

Figure 7:
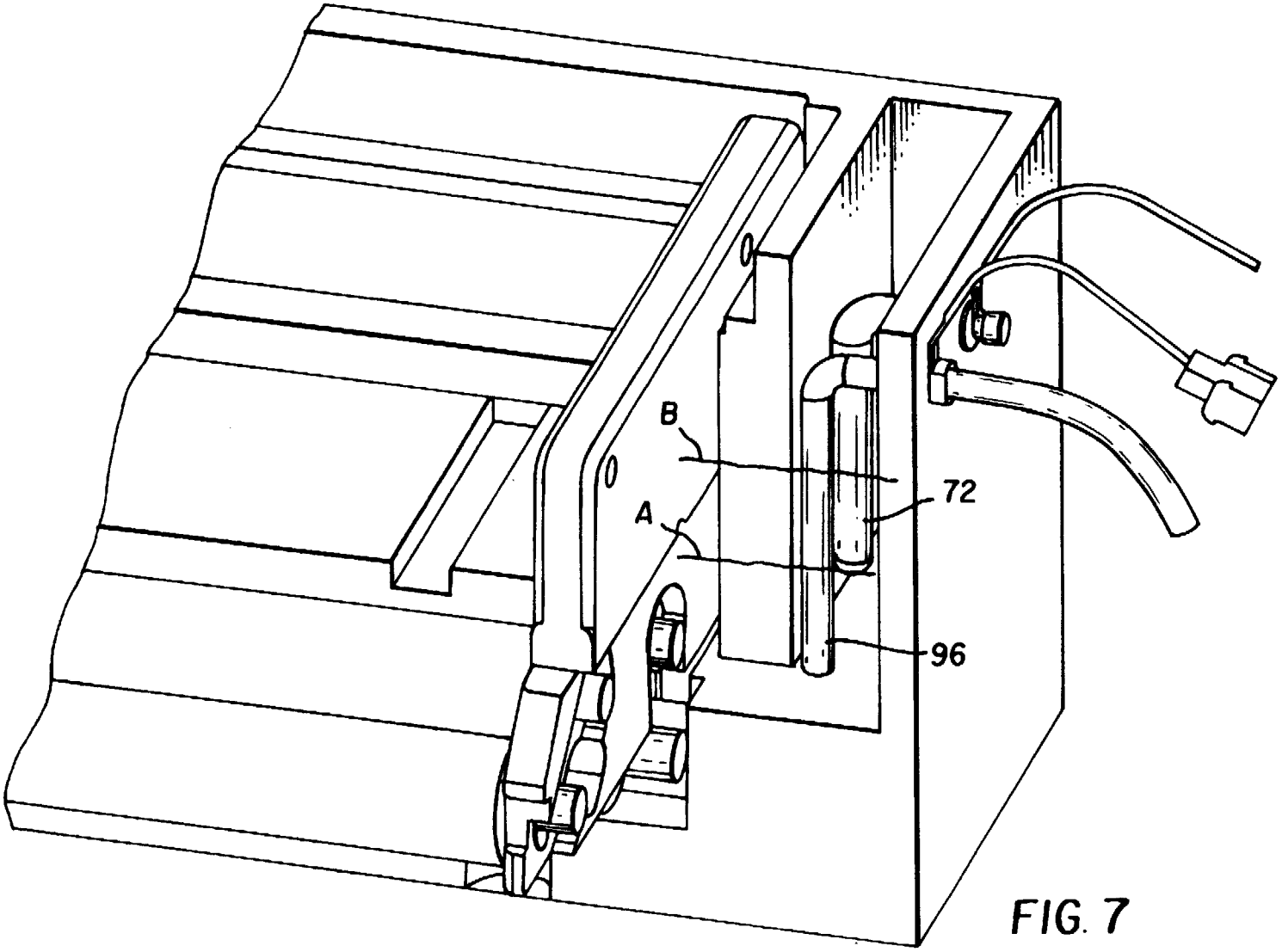
FIG. 7 is a schematic diagram of a modified processing apparatus made in accordance with the present invention.
Figure 8:
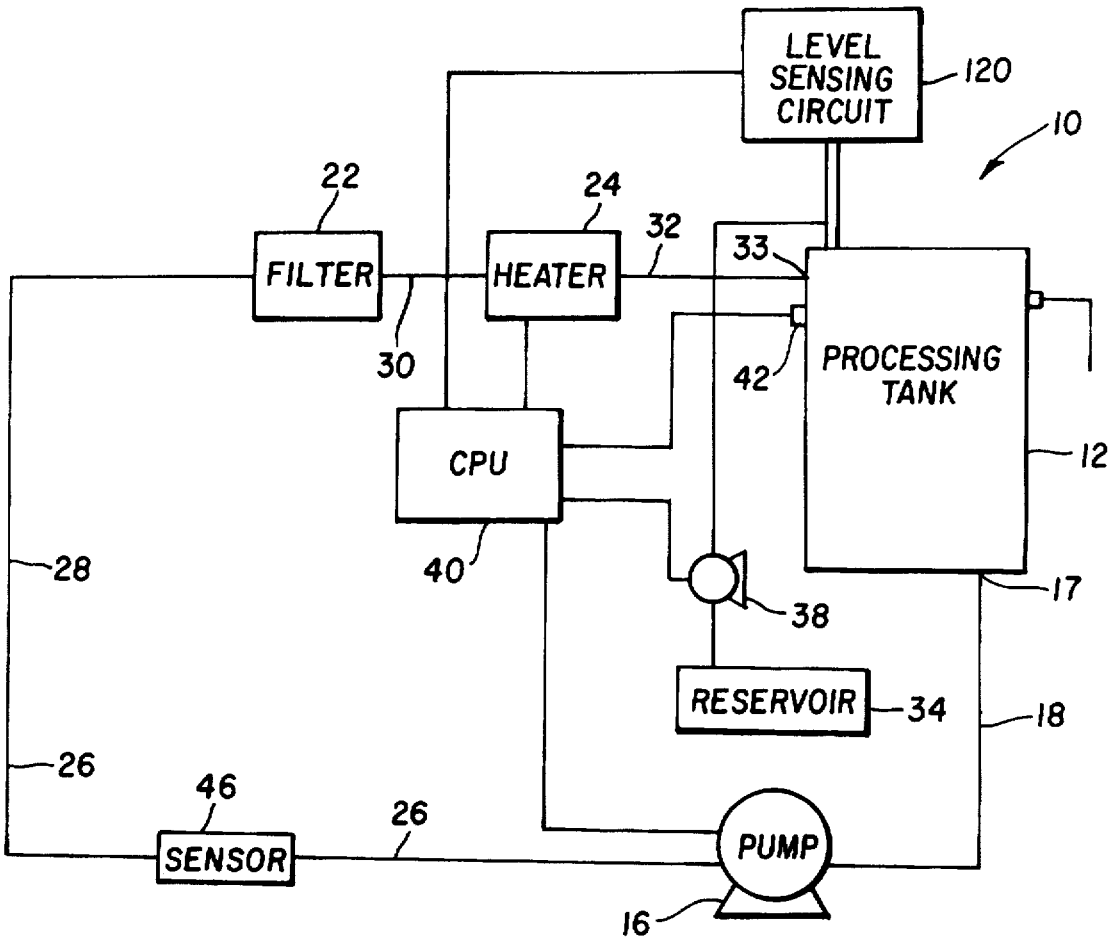
FIG. 8 is a partial perspective view of the processing tank of FIG. 7 and the monitor and delivery system according to the present invention for monitoring the level of processing solution in the processing tank and for supplying additional processing solution to the processing tank.

Referring to FIG. 7 there is illustrated a schematic diagram of a modified apparatus 200 made in accordance with the present invention. Apparatus 200 is similar to apparatus 10, like numerals indicating like parts and operation. Apparatus 200 is different from apparatus 10 in that instead of supplying the replenishment solution from reservoir 34 to manifold 20 in the recirculation system, the replenishment solution is supplied directly to the processing tank 12. Referring to FIG. 8 there is illustrated in greater detail means for monitoring the level of the processing solution within tank 12 and for supplying additional processing solution when the level of the processing solution falls below a predetermined level. A first level sensing rod 72 and a second level sensing tube 96 are secured to tank 12 such that the rod 72 and tube 96 extend down into the tank 12. The tank is made of a non-electrically conductive material. The tube 96 is fluidly connected to reservoir 34, as previously discussed, such that processing solution from the reservoir 34 will be delivered when processing solution within the tank falls below level "A" shown by dash lines in FIG. 8. In order to more clearly understand the operation of this embodiment, a brief description of its operation will now be described. When processing solution falls below level "A" sensing circuit will provide a signal for supplying a predetermined amount of processing solution to tank 12 such that the level of the processing solution within tank 12 will rise to the level indicated by dash line "B".

The present invention provides an improved flow monitoring system and fluid supply system which is low cost, accurate, and is not subject to corrosive effects of the processing solution.

It is to be understood that various changes and modifications may be made without departing from the scope of the present invention, the present invention being defined by the claims that follow.

PARTS LIST

10 ... processing apparatus
12 ... processing tank
14 ... recirculation system
16,38 ... pump
17 ... outlets
18 ... first conduit
20 ... manifold
22 ... filter unit
24 ... heater
26 ... second conduit
28 ... third conduit
30 ... fourth conduit
32 ... fifth conduit
33 ... inlet
34 ... reservoir
36 ... sixth conduit
39 ... conduit
40 ... CPU
42 ... sensor
46 ... flow monitoring sensor
47,48,49,50 ... developing sections
52 ... drying section
54 ... exiting slot
60 ... container
61 ... bottom
62 ... replenishment solution
64 ... neck portion
68 ... access opening
70 ... lid
72 ... first level sensing rod
74 ... upper end
76 ... internal threads
78 ... external threads
80 ... mounting screw

82,83 ... opening
84 ... electrical ring terminal
88 ... head
90,114 ... electrical wire
92 ... end
93 ... connector
96 ... second level sensing tube
97,99 ... internal passage
98 ... upper end
100 ... internal threads
101 ... opening
102 ... external threads
104 ... mounting fitting
106 ... opening
108 ... electrical ring terminal
110 ... opening
112 ... head
116 ... end
120 ... sensing circuit
122 ... bottom end
130 ... disconnect assembly
132,134 ... electrical terminals
135 ... mounting plate
138,140 ... spring members
142,144 ... flexible lower spring end
146,148 ... upper portion
200 ... apparatus

We claim:

1. A processor for processing a photosensitive material, comprising:

at least one processing tank for holding a processing solution;

a processing solution level monitoring and replenishment system for monitoring the level of the processing solution within said processing tank and for delivering replenishment solution to said processing tank, said replenishment system including a single means for supplying replenishment solution to said processing tank and for monitoring the level of the replenishment in said processing tank;

wherein said single means comprises a first electrically conductive rod of a first predetermined length and a tube of a second predetermined length, said rod and tube extending into a container which contains the replenishment solution and being positioned for detection when the replenishment solution falls to a predetermined level, said tube being capable of supplying replenishment solution to said processing tank.

2. A processor according to claim 1 further comprising a level sensing circuit, said circuit being electrically connected to said rod and said tube and applying an AC current thereto.

3. A processor according to claim 2 wherein said tube extends below said rod and said level sensing circuit produces a signal when the processing solution falls below the bottom of the rod.

4. A processor according to claim 1 wherein said rod and said tube are secured to said container, said container is made of a non-electrically conductive material and said rod and said tube are made of an electrically conductive material.

5. A processor according to claim 4 wherein said rod and said tube are made of stainless steel.

6. A processor according to claim 2 wherein means are provided for allowing automatic quick electrical disconnect and connection of said rod and tube to said level sensing circuit.

7. A method for supplying or withdrawing a processing solution to or from a container and for monitoring the level of said processing solution within said container, said container being electrically non-conductive, the method comprising the steps of:

providing a first electrically conductive member within said container and a spaced second electrically conductive tube within said container, said tube having a passageway for allowing processing solution to flow therethrough;

applying an AC current to said first electrically conductive member and said tube;

monitoring said AC current with a level sensing circuit; and producing a low level indicating signal based on said monitoring of said AC current.

8. A method according to claim 7 further comprising the step of controlling the flow of processing solution through said tube when said low level indicating signal is produced.

9. A processor for processing a photosensitive material, comprising:

at least one processing section having a processing tank for holding a processing solution;

a replenishment system for delivering a replenishment solution to said processing tank and for monitoring the level of the processing solution contained in said processing tank, said replenishment system comprising a container which contains the replenishment solution, a first electrically conductive rod of a first predetermined length and a tube of a second predetermined length, said rod and tube extending into said container at different distances and being positioned for detection when the replenishment solution falls to a predetermined level, said tube being capable of allowing processing solution to flow therethrough.

10. A processor according to claim 9 further comprising a level sensing circuit, said circuit being electrically connected to said rod and said tube for applying an AC current thereto.

11. A processor according to claim 10 wherein said tube extends further into said container than said rod and said level sensing circuit produces a signal when the processing solution falls below the bottom of the rod.

12. A processor according to claim 11 wherein said rod and said tube are secured to said container, said container being made of an non-electrically conductive material and said rod and said tube are made of an electrically conductive material.

13. A processor according to claim 12 wherein said rod and said tube are made of stainless steel.

14. A processor according to claim 10 wherein means are provided for allowing automatic quick electrical disconnect and connection of said rod and tube to said level sensing circuit.

15. A processor for processing a photosensitive material, comprising:

at least one container for holding a processing solution;

a processing solution level monitoring and delivery system for monitoring the level of said processing solution within said container and for controlling the flow of processing solution to or from said container, said processing solution level monitoring and delivery system including a single means for controlling the flow of processing solution to or from said container and for monitoring the level of the processing solution in said container;

wherein said single means comprises a first electrically conductive rod of a first predetermined length and a tube of a second predetermined length, said rod and tube extending into said container and being positioned for detection when the solution falls to a predetermined level, said tube being capable of allowing processing solution to flow therethrough.

16. A processor according to claim 15 further comprising a level sensing circuit, said circuit being electrically connected to said rod and said tube for applying an AC current thereto.

17. A processor according to claim 16 wherein said tube extends below said rod and said level sensing circuit produces a signal when the processing solution falls below the bottom of the rod.

18. A processor according to claim 15 wherein said rod and said tube are secured to said container, said container is made of a non-electrically conductive material and said rod and said tube are made of an electrically conductive material.

* * * * *